US006065264A

United States Patent [19]

Imler et al.

[11] Patent Number: 6,065,264

[45] Date of Patent: May 23, 2000

[54] FLOORING SYSTEM

[76] Inventors: Darlene F. Imler; James M. Imler, both of 124 Queen Ridge Rd., Jefferson City, Mo. 65109

[21] Appl. No.: 09/220,954

[22] Filed: Dec. 24, 1998

[51] Int. Cl.[7] ..... E04B 5/02

[52] U.S. Cl. ..... 52/589.1; 52/591.1; 52/588.1; 52/480

[58] Field of Search ..... 52/589.1, 591.1, 52/588.1, 480

[56] References Cited

U.S. PATENT DOCUMENTS

| | | | |
|---|---|---|---|
| 1,602,256 | 10/1926 | Sellin | 52/591.1 |
| 1,602,267 | 10/1926 | Karwisch | 52/591.1 |
| 2,887,426 | 5/1959 | Knold | 52/591.1 X |
| 3,608,258 | 9/1971 | Spratt | 52/591.1 X |
| 3,921,312 | 11/1975 | Fuller | 52/589.1 X |
| 4,416,100 | 11/1983 | Troendle, Sr. | 52/591.1 X |
| 5,519,971 | 5/1996 | Ramirez | 52/589.1 X |
| 5,634,309 | 6/1997 | Polen | 52/591.1 X |
| 5,822,944 | 10/1998 | Penland, Sr. | 52/591.1 |

*Primary Examiner*—Carl D. Friedman
*Assistant Examiner*—Phi Dieu Tran A

[57] ABSTRACT

A flooring system for providing a floor surface in a camping tent. The flooring system includes a plurality of interlocking planks each comprising upper and lower faces, a pair of opposite end edges, a pair of side edges extending between the end edges of the interlocking plank, and a longitudinal axis extending between the end edges of the interlocking plank. A first of the side edges of each interlocking plank has an elongate channel therein extending between the end edges of the interlocking plank. A second of the side edges of each interlocking plank has an elongate tongue portion outwardly extending therefrom between the end edges of the interlocking plank. Each of the end edges of each interlocking plank has a socket therein extending between the side edges of the interlocking plank. The interlocking planks are arranged in a row along the side edges of the interlocking planks such that the longitudinal axes of the interlocking planks are generally parallel to one another. Each tongue portion of a first side edge of an interlocking plank adjacent a second side edge of an interlocking plank is slidably inserted into the elongate channel of the adjacent interlocking plank.

10 Claims, 2 Drawing Sheets

FLOORING SYSTEM

BACKGROUND OF THE INVENTION

1. Field of the Invention

The present invention relates to flooring systems and more particularly pertains to a new flooring system for providing a floor surface in a camping tent.

2. Description of the Prior Art

The use of flooring systems is known in the prior art. More specifically, flooring systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,635,245; U.S. Pat. No. 5,052,158; U.S. Pat. No. Des. 329,914; U.S. Pat. No. 4,860,516; U.S. Pat. No. 4,303,969; and U.S. Pat. No. 4,299,069.

While these devices fulfill their respective, particular objectives and requirements, the aforementioned patents do not disclose a new flooring system. The inventive device includes a plurality of interlocking planks each comprising upper and lower faces, a pair of opposite end edges, a pair of side edges extending between the end edges of the interlocking plank, and a longitudinal axis extending between the end edges of the interlocking plank. A first of the side edges of each interlocking plank has an elongate channel therein extending between the end edges of the interlocking plank. A second of the side edges of each interlocking plank has an elongate tongue portion outwardly extending therefrom between the end edges of the interlocking plank. Each of the end edges of each interlocking plank has a socket therein extending between the side edges of the interlocking plank. The interlocking planks are arranged in a row along the side edges of the interlocking planks such that the longitudinal axes of the interlocking planks are generally parallel to one another. Each tongue portion of a first side edge of an interlocking plank adjacent a second side edge of an interlocking plank is slidably inserted into the elongate channel of the adjacent interlocking plank.

In these respects, the flooring system according to the present invention substantially departs from the conventional concepts and designs of the prior art, and in so doing provides an apparatus primarily developed for the purpose of providing a floor surface in a camping tent.

SUMMARY OF THE INVENTION

In view of the foregoing disadvantages inherent in the known types of flooring systems now present in the prior art, the present invention provides a new flooring system construction wherein the same can be utilized for providing a floor surface in a camping tent.

The general purpose of the present invention, which will be described subsequently in greater detail, is to provide a new flooring system apparatus and method which has many of the advantages of the flooring systems mentioned heretofore and many novel features that result in a new flooring system which is not anticipated, rendered obvious, suggested, or even implied by any of the prior art flooring systems, either alone or in any combination thereof.

To attain this, the present invention generally comprises a plurality of interlocking planks each comprising upper and lower faces, a pair of opposite end edges, a pair of side edges extending between the end edges of the interlocking plank, and a longitudinal axis extending between the end edges of the interlocking plank. A first of the side edges of each interlocking plank has an elongate channel therein extending between the end edges of the interlocking plank. A second of the side edges of each interlocking plank has an elongate tongue portion outwardly extending therefrom between the end edges of the interlocking plank. Each of the end edges of each interlocking plank has a socket therein extending between the side edges of the interlocking plank. The interlocking planks are arranged in a row along the side edges of the interlocking planks such that the longitudinal axes of the interlocking planks are generally parallel to one another. Each tongue portion of a first side edge of an interlocking plank adjacent a second side edge of an interlocking plank is slidably inserted into the elongate channel of the adjacent interlocking plank.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new flooring system apparatus and method which has many of the advantages of the flooring systems mentioned heretofore and many novel features that result in a new flooring system which is not anticipated, rendered obvious, suggested, or even implied by any of the prior art flooring systems, either alone or in any combination thereof.

It is another object of the present invention to provide a new flooring system which may be easily and efficiently manufactured and marketed.

It is a further object of the present invention to provide a new flooring system which is of a durable and reliable construction.

An even further object of the present invention is to provide a new flooring system which is susceptible of a low cost of manufacture with regard to both materials and labor, and which accordingly is then susceptible of low prices of sale to the consuming public, thereby making such flooring system economically available to the buying public.

Still yet another object of the present invention is to provide a new flooring system which provides in the apparatuses and methods of the prior art some of the advantages thereof, while simultaneously overcoming some of the disadvantages normally associated therewith.

Still another object of the present invention is to provide a new flooring system for providing a floor surface in a camping tent.

Yet another object of the present invention is to provide a new flooring system which includes a plurality of interlocking planks each comprising upper and lower faces, a pair of opposite end edges, a pair of side edges extending between the end edges of the interlocking plank, and a longitudinal axis extending between the end edges of the interlocking plank. A first of the side edges of each interlocking plank has an elongate channel therein extending between the end edges of the interlocking plank. A second of the side edges of each interlocking plank has an elongate tongue portion outwardly extending therefrom between the end edges of the interlocking plank. Each of the end edges of each interlocking plank has a socket therein extending between the side edges of the interlocking plank. The interlocking planks are arranged in a row along the side edges of the interlocking planks such that the longitudinal axes of the interlocking planks are generally parallel to one another. Each tongue portion of a first side edge of an interlocking plank adjacent a second side edge of an interlocking plank is slidably inserted into the elongate channel of the adjacent interlocking plank.

Still yet another object of the present invention is to provide a new flooring system that provides a supportive, comfortable and dry sleeping surface in a camping tent even while sleeping on wet and rocky terrain.

Even still another object of the present invention is to provide a new flooring system that may be easily disassembled for convenient transport and storage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
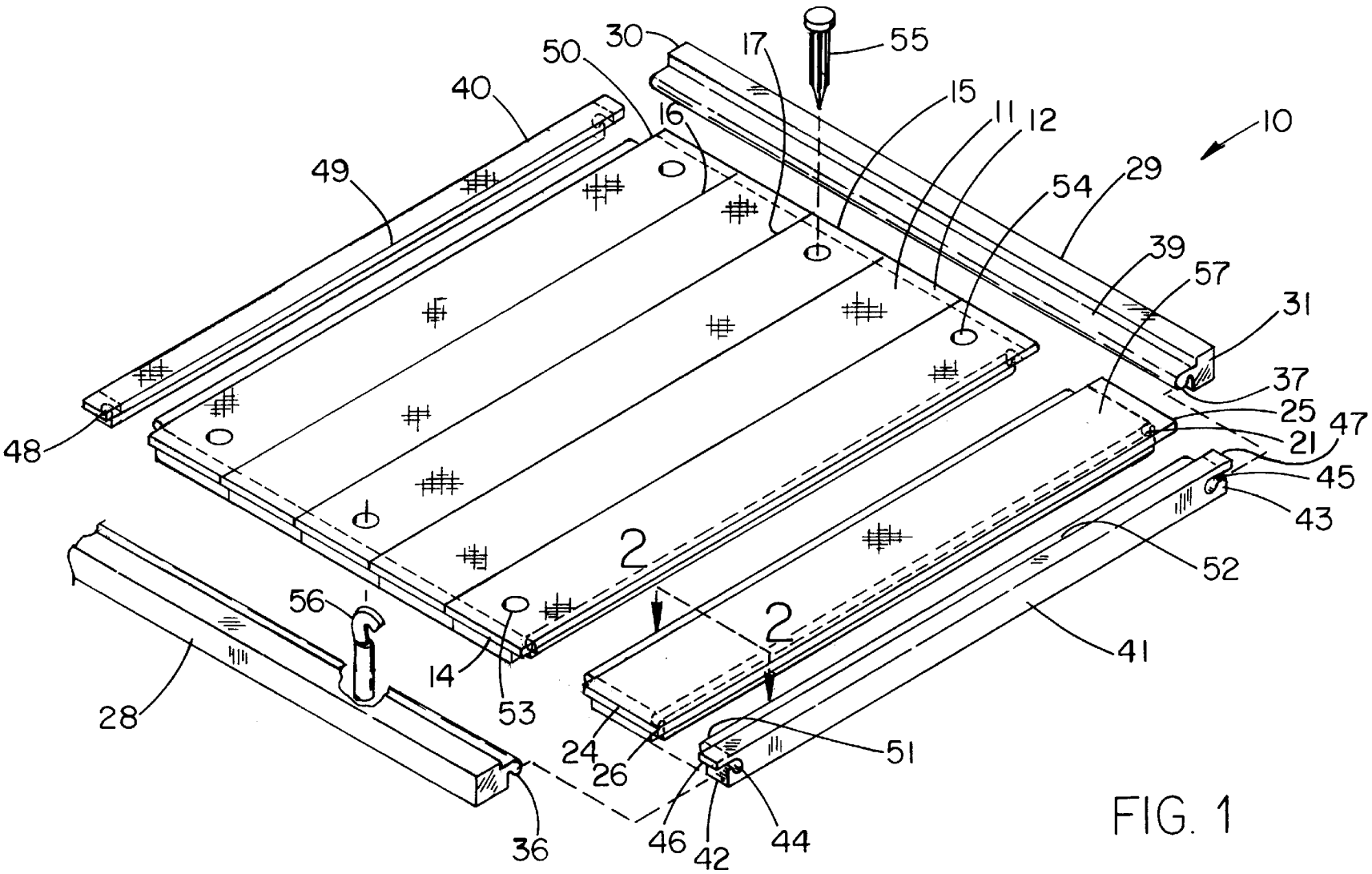
FIG. 1 is a schematic exploded perspective view of a new flooring system according to the present invention.

With reference now to the drawings, and in particular to FIGS. 1 through 4 thereof, a new flooring system embodying the principles and concepts of the present invention and generally designated by the reference numeral 10 will be described.

As best illustrated in FIGS. 1 through 4, the flooring system 10 generally comprises a plurality of interlocking planks 11 each comprising upper and lower faces 12,13, a pair of opposite end edges 14,15, a pair of side edges 16,17 extending between the end edges of the interlocking plank, and a longitudinal axis extending between the end edges of the interlocking plank. A first of the side edges 16 of each interlocking plank has an elongate channel 18 therein extending between the end edges of the interlocking plank. A second of the side edges 17 of each interlocking plank has an elongate tongue portion 19 outwardly extending therefrom between the end edges of the interlocking plank. Each of the end edges of each interlocking plank has a socket 20,21 therein extending between the side edges of the interlocking plank. The interlocking planks are arranged in a row along the side edges of the interlocking planks such that the longitudinal axes of the interlocking planks are generally parallel to one another. Each tongue portion of a first side edge of an interlocking plank adjacent a second side edge of an interlocking plank is slidably inserted into the elongate channel of the adjacent interlocking plank.

In closer detail, the flooring system 10 comprises a plurality of interlocking planks 11 with each of the interlocking planks comprising generally planar upper and lower faces 12,13, a pair of opposite end edges 14,15, a pair of side edges 16,17 extending between the end edges of the interlocking plank, and a longitudinal axis extending between the end edges of the interlocking plank. A first of the side edges 16 of each interlocking plank has an elongate channel 18 therein extending between the end edges of the interlocking plank. A second of the side edges 17 of each interlocking plank has an elongate tongue portion 19 outwardly extending therefrom between the end edges of the interlocking plank. The first side edge of each interlocking plank also has an elongate notch channel 22 extending between the end edges of the interlocking plank adjacent the upper face of the interlocking plank. The second side edge of each interlocking plank has an elongate notch tongue 23 extending between the end edges of the interlocking plank adjacent the upper face of the interlocking plank. Each of the end edges of each interlocking plank also has a socket 20,21 therein extending between the side edges of the interlocking plank. Each of the end edges of the interlocking plank has a top flange 24,25 outwardly extending therefrom between the side edges of the interlocking plank adjacent the upper surface of interlocking plank.

Figure 2:
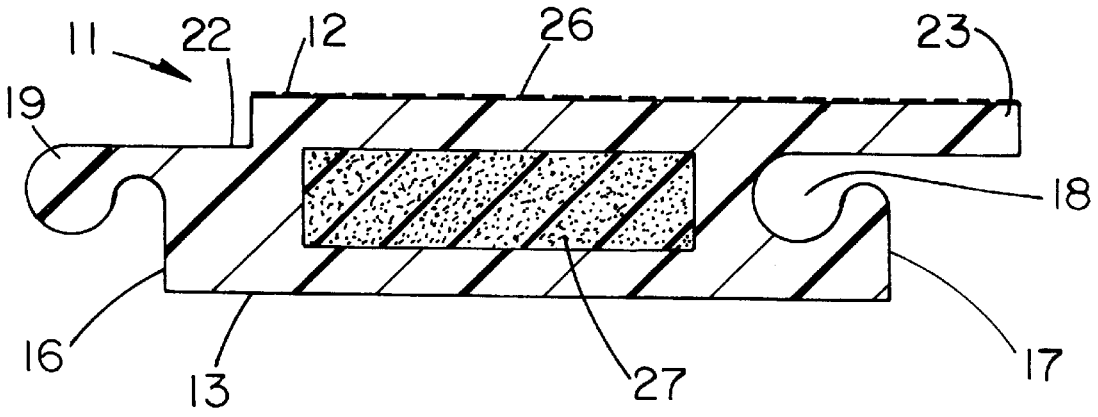
FIG. 2 is a schematic cross sectional view of an interlocking lank of the present invention taken from line 2—2 of FIG. 1.

Preferably, the upper face 12 of each interlocking plank has a frictionally enhanced surface 26 with respect to a smooth surface to help prevent a user standing on the upper face of the interlocking plank from slipping. Ideally, the interlocking planks comprise a resilient rigid plastic material with an inner core 27 therein extending between the end edges of the interlocking plank. As illustrated in FIG. 2, the inner core of the interlocking plank has a generally rectangular transverse cross section generally perpendicular to the longitudinal axis of the interlocking plank. The inner core ideally comprises a resiliently compressible foamed material such as Styrofoam for providing additional insulation and reduction of weight to the interlocking plank. Each interlocking plank has a length defined between the end edges of the interlocking plank, a width defined between the side edges of the interlocking plank and a thickness defined between the upper and lower surfaces of the interlocking plank. In an ideal illustrative embodiment, the length of each interlocking plank is about 48 inches, the width is about 6 inches, and the thickness is about 3 inches. These are ideal dimensions for using the flooring system 10 as a floor structure in most camping tents.

As illustrated in FIG. 1, the interlocking planks are arranged in a row along the side edges of the interlocking planks such that the longitudinal axes of the interlocking planks are generally parallel to one another. One end edge of each of the interlocking planks is arranged along a first common line in the row of interlocking plank while the other end edge of each of the interlocking planks is arranged along a second common line in the row of interlocking planks. The upper surfaces of the interlocking planks are generally coplanar in the row of interlocking planks and the upper surfaces of the interlocking planks are generally coplanar in the row of interlocking planks in the row.

Each tongue portion of a first side edge of an interlocking plank adjacent a second side edge of an interlocking plank is slidably inserted into the elongate channel of the adjacent interlocking plank. With reference to FIG. 2, the tongue portions and the elongate channels of the interlocking planks are of complementary interlocking transverse cross sections generally perpendicular to the longitudinal axes of the interlocking plank to prevent pulling apart of adjacent interlocking planks without relative sliding therebetween. In the row, each notch channel of a first side edge of an interlocking plank adjacent a second side edge of an interlocking plank receives therein the notch tongue of the adjacent interlocking plank.

Figure 3:
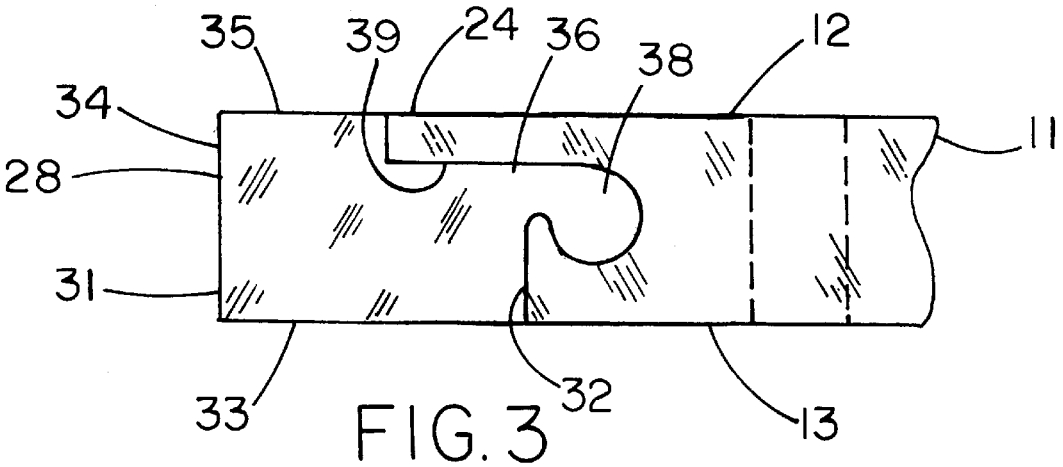
FIG. 3 is a schematic side view of the region adjacent a side rail of the present invention.
Figure 4:
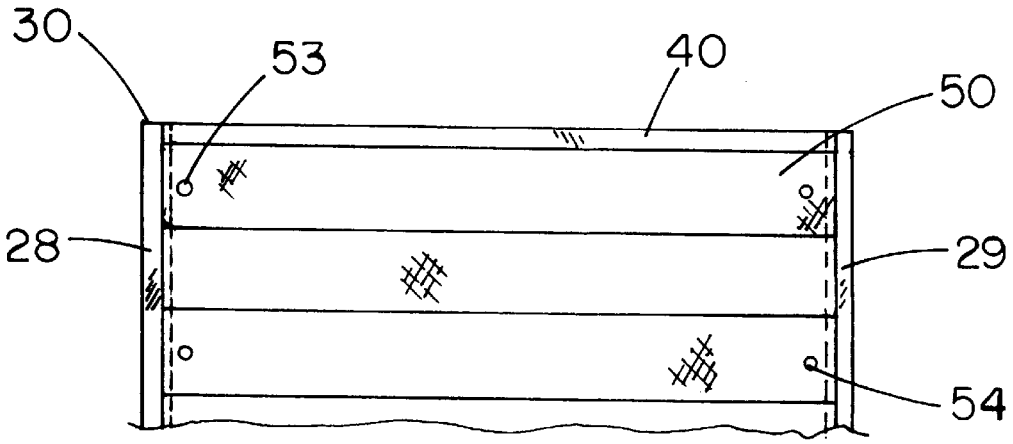
FIG. 4 is a schematic partial top view of the present invention.

The flooring system 10 also includes a pair of elongate side rails 28,29. Each side rail comprises a pair of opposite ends 30,31, a plurality of sides 32,33,34,35 extending between the ends of the side rail, and a longitudinal axis extending between the ends of the side rail. With reference to FIG. 3, each side rail has a generally rectangular transverse cross section generally perpendicular to the longitudinal axis of the side rail. One of the sides of each side rail has an tongue portion 36,37 outwardly extending therefrom between the ends of the side rail. As illustrated in FIG. 3, the tongue portion of the side rail has a lobe region 38 with a generally circular transverse cross section generally perpendicular to the longitudinal axis of the side rail. Each side rail also has an elongate notch 39 extending between the ends of the side rail adjacent the tongue portion of the side rail.

With reference to FIG. 1, the tongue portion of a first of the side rails 28 is slidably inserted into the socket of a first of the end edges of each of the interlocking planks. As shown in FIG. 3, the tongue portion of the first side rail and the sockets of the first end edges of the interlocking planks are of complementary interlocking transverse cross sections generally perpendicular to the longitudinal axes of the first side rail to prevent pulling apart of the first side rail from the first end edges of the interlocking planks without relative sliding therebetween. Additionally, the elongate notch of the first side rail receives the top flanges of the first end edges of the interlocking planks to help hold the flooring system rigid.

Similarly, the tongue portion of a second of the side rails 29 is slidably inserted into the socket of a second of the end edges of each of the interlocking planks. The tongue portion of the second side rail and the sockets of the second end edges of the interlocking planks are of complementary interlocking transverse cross sections generally perpendicular to the longitudinal axes of the second side rail to prevent pulling apart of the second side rail from the second end edges of the interlocking planks without relative sliding therebetween. In a similar fashion as the first side rail, the elongate notch of the second side rail receives the top flanges of the second end edges of the interlocking planks.

The flooring system further includes a pair of elongate end rails 40,41. Each end rail comprises a pair of opposite ends 42,43, a plurality of sides extending between the ends of the end rail, and a longitudinal axis extending between the ends of the end rail. The end rails preferably have a generally rectangular transverse cross section generally perpendicular to the longitudinal axis of the respective end rail. Each of the ends of the end rail has a socket therein 44,45. The sockets of the ends of each end rail has a transverse cross section complementary to the transverse cross section of the tongue portion of the side rail. Each of the ends of each end rail also has a outwardly extending flange 46,47. A first of the end rails 40 has an elongate channel 48 therein extending between the ends of the first end rail. The first end rail has an elongate notch tongue 49 extending between the ends of the first end rail. The tongue portion of a first terminal interlocking plank 50 at one end of the row of interlocking planks is slidably inserted into the elongate channel of the first end rail. The tongue portion of the first terminal interlocking plank and the elongate channel of the first end rail are of complementary interlocking transverse cross sections generally perpendicular to the longitudinal axes of the interlocking plank to prevent pulling apart of the first terminal interlocking plank and the first end rail without relative sliding therebetween. The notch channel of the first terminal interlocking plank receives therein the notch tongue of the first end rail.

A second of the end rails 41 has an elongate tongue portion 51 outwardly extending therefrom between the ends of the second end rail. The second end rail also has an elongate notch channel 52 extending between the ends of the second end rail. The tongue portion of the second end rail is slidably inserted into the elongate channel of a second terminal interlocking plank 57 at another end of the row of interlocking planks. The tongue portion of the second end rail and the elongate channel of the first terminal interlocking plank are of complementary interlocking transverse cross sections generally perpendicular to the longitudinal axes of the interlocking plank to prevent pulling apart of the second terminal interlocking plank and the second end rail without relative sliding therebetween. The notch channel of the second end rail receives therein the notch tongue of the second terminal interlocking plank.

The tongue portion of the first side rail is slidably inserted into the socket of a first end of each of the end rails. The tongue portion of the first side rail, and the sockets of the second ends of the end rails are of complementary interlocking transverse cross sections generally perpendicular to the longitudinal axes of the first side rail to prevent pulling apart of the first side rail from the first ends of the end rails without relative sliding therebetween. The tongue portion of the second side rail is slidably inserted into the socket of a second end of each of the end rails. The tongue portion of the second side rail, and the sockets of the second ends of the end rails are of complementary interlocking transverse cross sections generally perpendicular to the longitudinal axes of the second side rail to prevent pulling apart of the second side rail from the second ends of the end rails without relative sliding therebetween. This forms a complete floor structure that may then be laid on the ground in a camping tent to provide an insulating and moisture barrier flooring to the camping tent.

A number of the interlocking planks have a pair of bores 53,54 extending therethrough between the upper and lower faces of the respective interlocking plank. Ideally, the number of interlocking planks with a pair of bores alternate with interlocking planks without bores in the row. One of the bores of each interlocking plank is positioned adjacent one end edge of the respective interlocking plank with the other bore of each interlocking plank is positioned adjacent the other end edge of the respective interlocking plank. Ideally, each of the bores has a diameter of about 2½ inches. In use, each of the bores is adapted for extending ground spikes 55 and tie-down hooks 56 therethrough for securing the row of interlocking planks to a ground surface and a tent structure. In the ideal illustrative embodiment, each tie-down hook has a length of about 4½ inches and each ground spike has a length of about 7 inches.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A flooring system, comprising:

a plurality of interlocking planks, each of said interlocking planks comprising:

upper and lower faces, a pair of opposite end edges, a pair of side edges extending between said end edges of said interlocking plank, and a longitudinal axis extending between said end edges of said interlocking plank;

a first of said side edges of said interlocking plank having an elongate channel therein extending between said end edges of said interlocking plank;

a second of said side edges of said interlocking plank having an elongate tongue portion outwardly extending therefrom between said end edges of said interlocking plank; and each of said end edges of said interlocking plank having a socket therein extending between said side edges of said interlocking plank;

said interlocking planks being arranged in a row along said side edges of said interlocking planks such that said longitudinal axes of said interlocking planks are generally parallel to one another;

each tongue portion of a first side edge of an interlocking plank adjacent a second side edge of an interlocking plank being slidably inserted into the elongate channel of the adjacent interlocking plank;

a pair of elongate side rails;

each of said side rails comprising:

a pair of opposite ends, a plurality of sides extending between said ends of said side rail, and a longitudinal axis extending between said ends of said side rail; and one of said sides of said side rail having an tongue portion outwardly extending therefrom between said ends of said side rail;

said tongue portion of a first of said side rails being slidably inserted into the socket of a first of said end edges of each of said interlocking planks;

said tongue portion of a second of said side rails, being slidably inserted into the socket of a second of said end edges of each of said interlocking planks;

a pair of elongate end rails, each of said end rails comprising:

a pair of opposite ends, a plurality of sides extending between said ends of said end rail, and a longitudinal axis extending between said ends of said end rail; and each of said ends of said end rail having a socket therein;

a first of said end rails having an elongate channel therein extending between said ends of said first end rail;

the tongue portion of a first terminal interlocking plank at one end of said row of interlocking planks being slidably inserted into the elongate channel of said first end rail;

a second of said end rails having an elongate tongue portion outwardly extending therefrom between said ends of said second end rail;

said tongue portion of said second end rail being slidably inserted into the elongate channel of a second terminal interlocking plank at another end of said row of interlocking planks;

said tongue portion of said first side rail being slidably inserted into the socket of a first end of each of said end rails; and said tongue portion of said second side rail being slidably inserted into the socket of a second end of each of said end rails.

2. The flooring system of claim 1, wherein said first side edge of each of said interlocking planks has an elongate notch channel extending between said end edges of said interlocking plank adjacent said upper face of said interlocking plank, and wherein said second side edge of each of said interlocking planks has an elongate notch tongue extending between said end edges of said interlocking plank adjacent said upper face of said interlocking plank, and wherein each notch channel of a first side edge of an interlocking plank adjacent a second side edge of an interlocking plank receives therein the notch tongue of the adjacent interlocking plank.

3. The flooring system of claim 1, wherein said upper face of each of said interlocking planks has a frictionally enhanced surface with respect to a smooth surface to help prevent a user standing on said upper face of said interlocking plank from slipping.

4. The flooring system of claim 1, wherein each of said interlocking planks has an inner core therein extending between said end edges of the respective interlocking plank, said inner core having a generally rectangular transverse cross section generally perpendicular to said longitudinal axis of the respective interlocking plank, said inner core comprising a resiliently compressible foamed material.

5. The flooring system of claim 1, wherein said interlocking plank has a length defined between said end edges of said interlocking plank, a width defined between said side edges of said interlocking plank and a thickness defined between said upper and lower surfaces of said interlocking plank, wherein said length of said interlocking plank is about 48 inches, said width of said interlocking plank is about 6 inches, and said thickness of said interlocking plank is about 3 inches.

6. The flooring system of claim 1, wherein said tongue portions and said elongate channels of said interlocking planks are of complementary transverse cross sections to prevent pulling apart of adjacent interlocking planks without relative sliding therebetween.

7. The flooring system of claim 1, wherein said tongue portion of said first side rail and said sockets of said first end edges of said interlocking planks are of complementary transverse cross sections to prevent pulling apart of said first side rail from said first end edges of said interlocking planks without relative sliding therebetween, and wherein said tongue portion of said second side rail and said sockets of said second end edges of said interlocking planks are of complementary transverse cross sections to prevent pulling apart of said second side rail from said second end edges of said interlocking planks without relative sliding therebetween.

8. The flooring system of claim 1, wherein said tongue portion of said first terminal interlocking plank and said elongate channel of said first end rail are of complementary transverse cross sections to prevent pulling apart of said first terminal interlocking plank and said first end rail without relative sliding therebetween, and wherein said tongue portion of said second end rail and said elongate channel of said first terminal interlocking plank are of complementary transverse cross sections to prevent pulling apart of said second terminal interlocking plank and said second end rail without relative sliding therebetween.

9. The flooring system of claim 1, wherein a number of said interlocking planks have a pair of bores extending therethrough between said upper and lower faces of the respective interlocking plank, one of said bores of each interlocking plank being positioned adjacent one end edge of the respective interlocking plank, another of said bores of each interlocking plank being positioned adjacent another end edge of the respective interlocking plank, each of said bores being adapted for extending ground spikes and tie-down hooks therethrough for securing said row of interlocking planks to a ground surface and a tent structure.

10. A flooring system, comprising:

a plurality of interlocking planks, each of said interlocking planks comprising:

generally planar upper and lower faces, a pair of opposite end edges, a pair of side edges extending between said end edges of said interlocking plank, and a longitudinal axis extending between said end edges of said interlocking plank;

a first of said side edges of said interlocking plank having an elongate channel therein extending between said end edges of said interlocking plank;

a second of said side edges of said interlocking plank having an elongate tongue portion outwardly extending therefrom between said end edges of said interlocking plank;

said first side edge of said interlocking plank having an elongate notch channel extending between said end edges of said interlocking plank adjacent said upper face of said interlocking plank;

said second side edge of said interlocking plank having an elongate notch tongue extending between said end edges of said interlocking plank adjacent said upper face of said interlocking plank;

each of said end edges of said interlocking plank having a socket therein extending between said side edges of said interlocking plank;

each of said end edges of said interlocking plank having a top flange outwardly extending therefrom between said side edges of said interlocking plank adjacent said upper surface of interlocking plank;

said upper face of said interlocking plank having a frictionally enhanced surface with respect to a smooth surface to help prevent a user standing on said upper face of said interlocking plank from slipping;

said interlocking plank comprising a plastic material, said interlocking plank having an inner core therein extending between said end edges of said interlocking plank, said inner core of said interlocking plank having a generally rectangular transverse cross section generally perpendicular to said longitudinal axis of said interlocking plank, said inner core comprising a resiliently compressible foamed material;

said interlocking plank having a length defined between said end edges of said interlocking plank, a width defined between said side edges of said interlocking plank and a thickness defined between said upper and lower surfaces of said interlocking plank; and wherein said length of said interlocking plank is about 48 inches, said width of said interlocking plank is about 6 inches, and said thickness of said interlocking plank is about 3 inches;

said interlocking planks being arranged in a row along said side edges of said interlocking planks such that said longitudinal axes of said interlocking planks are generally parallel to one another, one of said end edges of each of said interlocking planks being arranged along a first common line in said row of interlocking plank, another of said end edges of each of said interlocking planks being arranged along a second common line in said row of interlocking planks, said upper surfaces of said interlocking planks being generally coplanar in said row of interlocking planks, said upper surfaces of said interlocking planks being generally coplanar in said row of interlocking planks;

each tongue portion of a first side edge of an interlocking plank adjacent a second side edge of an interlocking plank being slidably inserted into the elongate channel of the adjacent interlocking plank;

said tongue portions and said elongate channels of said interlocking planks being of complementary transverse cross sections to prevent pulling apart of adjacent interlocking planks without relative sliding therebetween;

each notch channel of a first side edge of an interlocking plank adjacent a second side edge of an interlocking plank receiving therein the notch tongue of the adjacent interlocking plank;

a pair of elongate side rails;

each of said side rails comprising:

a pair of opposite ends, a plurality of sides extending between said ends of said side rail, and a longitudinal axis extending between said ends of said side rail, said side rail having a generally rectangular transverse cross section generally perpendicular to said longitudinal axis of said side rail;

one of said sides of said side rail having an tongue portion outwardly extending therefrom between said ends of said side rail;

said tongue portion of said side rail having a lobe region, said lobe region of said tongue portion having a generally circular transverse cross section generally perpendicular to said longitudinal axis of said side rail; and said side rail having an elongate notch extending between said ends of said side rail adjacent said tongue portion of said side rail;

said tongue portion of a first of said side rails, being slidably inserted into the socket of a first of said end edges of each of said interlocking planks;

said tongue portion of said first side rail, and said sockets of said first end edges of said interlocking planks being of complementary transverse cross sections to prevent pulling apart of said first side rail from said first end edges of said interlocking planks without relative sliding therebetween;

said elongate notch of said first side rail receiving said top flanges of said first end edges of said interlocking planks;

said tongue portion of a second of said side rails, being slidably inserted into the socket of a second of said end edges of each of said interlocking planks;

said tongue portion of said second side rail, and said sockets of said second end edges of said interlocking planks being of complementary transverse cross sections to prevent pulling apart of said second side rail from said second end edges of said interlocking planks without relative sliding therebetween;

said elongate notch of said second side rail receiving said top flanges of said second end edges of said interlocking planks;

a pair of elongate end rails, each of said end rails comprising:

a pair of opposite ends, a plurality of sides extending between said ends of said end rail, and a longitudinal axis extending between said ends of said end rail, said end rail having a generally rectangular transverse cross section generally perpendicular to said longitudinal axis of said end rail;

each of said ends of said end rail having a socket therein, said sockets of said ends of said end rail having a transverse cross section complementary to said transverse cross section of said tongue portion of said side rail; and each of said ends of said end rail having a outwardly extending flange;

a first of said end rails having an elongate channel therein extending between said ends of said first end rail;

said first end rail having an elongate notch tongue extending between said ends of said first end rail;

the tongue portion of a first terminal interlocking plank at one end of said row of interlocking planks being slidably inserted into the elongate channel of said first end rail;

said tongue portion of said first terminal interlocking plank and said elongate channel of said first end rail being of complementary transverse cross sections to prevent pulling apart of said first terminal interlocking plank and said first end rail without relative sliding therebetween;

said notch channel of said first terminal interlocking plank receiving therein the notch tongue of said first end rail;

a second of said end rails having an elongate tongue portion outwardly extending therefrom between said ends of said second end rail;

said second end rail having an elongate notch channel extending between said ends of said second end rail;

said tongue portion of said second end rail being slidably inserted into the elongate channel of a second terminal interlocking plank at another end of said row of interlocking planks;

said tongue portion of said second end rail and said elongate channel of said first terminal interlocking plank being of complementary transverse cross sections to prevent pulling apart of said second terminal interlocking plank and said second end rail without relative sliding therebetween;

said notch channel of said second end rail receiving therein the notch tongue of said second terminal interlocking plank;

said tongue portion of said first side rail being slidably inserted into the socket of a first end of each of said end rails;

said tongue portion of said first side rail, and said sockets of said second ends of said end rails being of complementary transverse cross sections to prevent pulling apart of said first side rail from said first ends of said end rails without relative sliding therebetween;

said tongue portion of said second side rail being slidably inserted into the socket of a second end of each of said end rails;

said tongue portion of said second side rail, and said sockets of said second ends of said end rails being of complementary transverse cross sections to prevent pulling apart of said second side rail from said second ends of said end rails without relative sliding therebetween;

a number of said interlocking planks having a pair of bores extending therethrough between said upper and lower faces of the respective interlocking plank;

one of said bores of each interlocking plank being positioned adjacent one end edge of the respective interlocking plank, another of said bores of each interlocking plank being positioned adjacent another end edge of the respective interlocking plank;

each of said bores having a diameter of about 2½ inches;

each of said bores being adapted for extending ground spikes and tie-down hooks therethrough for securing said row of interlocking planks to a ground surface and a tent structure;

wherein each tie-down hook having a length of about 4½ inches; and wherein each ground spikes has a length of about 7 inches.

* * * * *